US005085057A

United States Patent [19]

Thompson et al.

[11] Patent Number: 5,085,057

[45] Date of Patent: * Feb. 4, 1992

[54] DUAL SIDE DISCHARGE ROOM AIR CONDITIONER WITH FOAMED INSULATION AIR PASSAGE WALLS

[75] Inventors: Christopher M. Thompson, Smyrna; Timothy J. Campbell, Nashville; Leonard T. Farfaglia, deceased, late of Brentwood, by Mary Farfaglia, heir; Billy P. Gipson, Marshall County; Thompson Matambo, Brentwood, all of Tenn.

[73] Assignee: Whirlpool Corporation, Benton Harbor, Mich.

[ * ] Notice: The portion of the term of this patent subsequent to Nov. 19, 2008 has been disclaimed.

[21] Appl. No.: 522,179

[22] Filed: May 11, 1990

[51] Int. Cl.[5] ..... F25D 23/12

[52] U.S. Cl. ..... 62/262; 415/177; 415/119; 165/135; 454/262

[58] Field of Search ..... 62/262; 415/177, 119; 98/38.2, 31.6; 165/135, 54

[56] References Cited

U.S. PATENT DOCUMENTS

| | | | |
|---|---|---|---|
| 2,737,788 | 3/1956 | Buttner . | |
| 2,952,997 | 9/1960 | Mullin . | |
| 2,989,855 | 6/1961 | Thompson . | |
| 3,159,983 | 12/1964 | Metcalfe . | |
| 3,221,512 | 12/1965 | Bakos . | |
| 3,472,149 | 10/1969 | Harrison . | |
| 3,724,233 | 4/1973 | Pugh et al. | 62/262 |
| 3,756,039 | 9/1973 | Riello | 62/262 |
| 3,783,637 | 1/1974 | Woods . | |
| 3,805,542 | 4/1974 | Hosoda | 62/262 |
| 3,938,348 | 2/1976 | Rickert . | |
| 4,100,764 | 7/1978 | Murano . | |
| 4,240,264 | 12/1980 | Nakada et al. . | |
| 4,492,094 | 1/1985 | Katayama . | |
| 4,563,126 | 1/1986 | Kobayashi et al. | 165/54 |

*Primary Examiner*—Albert J. Makay
*Assistant Examiner*—John Sollecito
*Attorney, Agent, or Firm*—Hill, Van Santen, Steadman & Simpson

[57] ABSTRACT

A room air conditioner in which a blower housing is formed of a foamed insulation material. The foamed insulation material is formed in three separate pieces with each of the pieces fitting together to form a single structural unit forming the blower housing and wall portions of two separate air conduits. The pieces are configured and apertured to fit snugly together and to provide various passages for diverse components of the air conditioner.

15 Claims, 4 Drawing Sheets

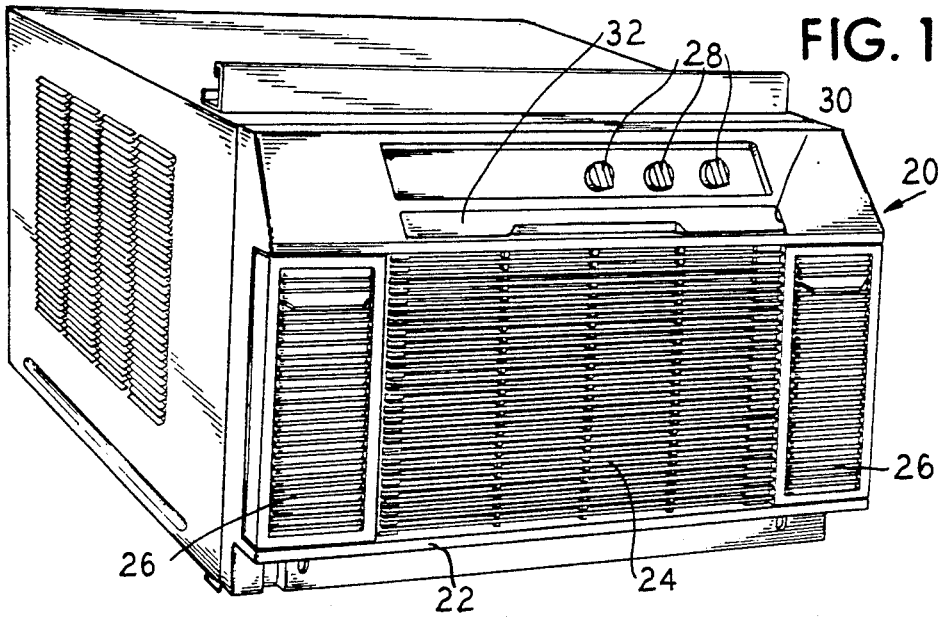
FIG. 1
FIG. 3
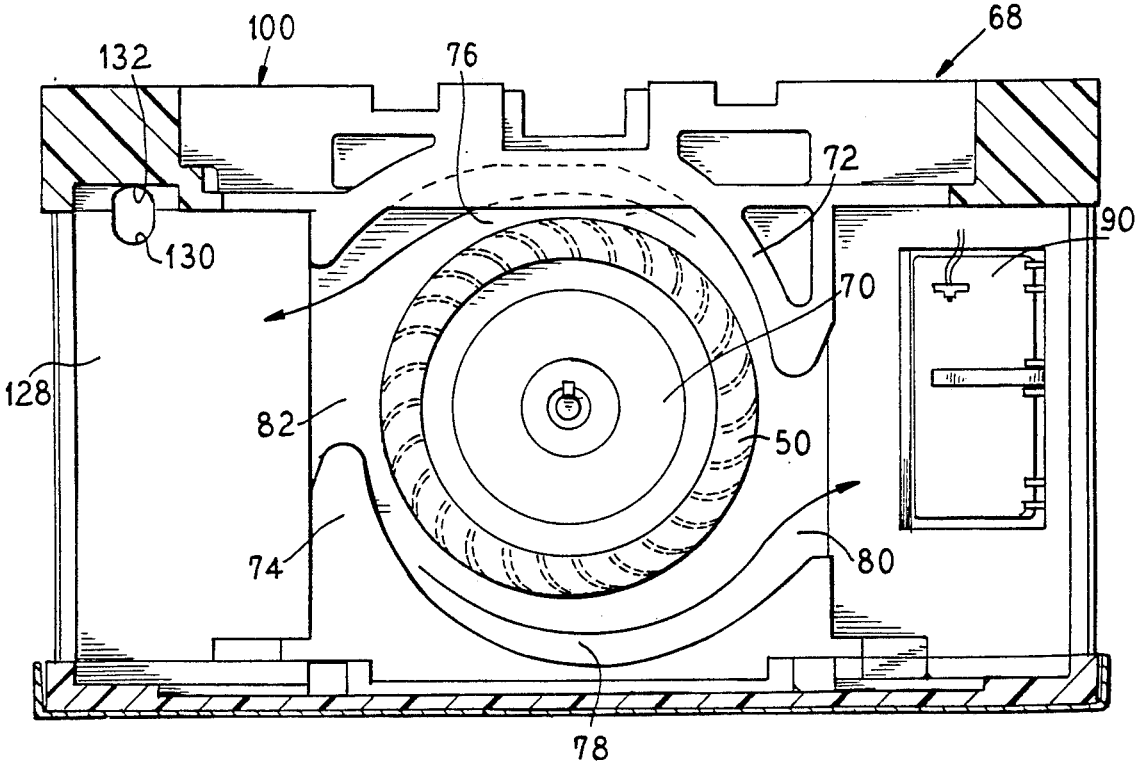

DUAL SIDE DISCHARGE ROOM AIR CONDITIONER WITH FOAMED INSULATION AIR PASSAGE WALLS

BACKGROUND OF THE INVENTION

The invention is directed to a room air conditioner and more particularly to a room air conditioner having foamed insulation walls forming at least a portion of the air passage within the air conditioner.

Room air conditioners generally have an air inlet and an air outlet at a front side of the air conditioner which faces the interior of the room when the air conditioner is positioned in a window opening or in a through the wall sleeve. Usually warm air is drawn in through a portion of the front panel to pass through a filter and through the evaporator coil to be cooled and then is directed by a blower or fan to an outlet or outlets, also in the front panel. The outlet may be a single opening positioned either along a top or bottom edge of the front panel or may be a single opening positioned at one side or the other of the front panel. Occasionally the air from the blower is directed into a manifold type box or plenum chamber and from that chamber it is allowed to exit through the front of the air conditioner through more than one opening. For example in U.S. Pat. No. 3,472,149, assigned to the assignee of the present invention, air is drawn into the air conditioner unit through a lower front grill portion and is redelivered to the room through a grill portion which extends along the top edge of the air conditioner.

In U.S. Pat. No. 2,737,788, air is drawn in from a front lower grill opening, through a filter and the air is pressurized by a fan mounted in a manifold chamber or plenum from which air is permitted to exit through two spaced grills. In U.S. Pat. No. 4,492,094 air is drawn in through a front grill, is pressurized by a fan and exits through a grill 30 located at a bottom edge of the front panel. FIGS. 1 and 2 of that patent illustrate prior art constructions of top and side return of cooled air to the room.

The use of a plenum chamber or similar structure requires an extra space in the air conditioner thereby reducing the compactness of the air conditioner and adding to bulkiness. Also such a structure requires extra parts and weight, thus increasing the costs and complexity of manufacturing. Oftentimes, particularly when the air outlet is positioned on a single side of the air conditioner, the air is drawn into the air conditioner evaporator coil in an off-center fashion thereby reducing the efficiency of the air conditioner.

The use of a foamed insulation material such as expanded polystyrene for forming various portions of the air passage within the air conditioner is known. For example, U.S. Pat. No. 2,989,855 utilizes an air deflector member positioned in the air outlet plenum chamber which forms three walls of the chamber and which includes a plurality of air directing vanes. U.S. Pat. No. 4,100,764 discloses the use of a multiple number of insulation boards formed of polystyrene resin foam including an interior fan case which houses the fan used to recirculate interior air and which housing surrounds a portion of the blower wheel. The housing forms a single volute opening and directs air up through a partially insulated passage to pass through the evaporator before returning to the room. The insulation boards are to be provided with a plurality of projections and grooves corresponding with each other and with portions of the refrigeration components so that the components are fixedly interposed therebetween, when assembled.

U.S. Pat. No. 3,938,348 discloses the use of a number of walls formed of insulating material including a wall positioned below the evaporator upon which condensed water will collect and which then passes through a water trap being a tube with U-shape bend in it to permit passage of condensed water from the evaporator portion of the air conditioner, through a barrier wall and into the compressor/condenser portion of the air conditioner.

SUMMARY OF THE INVENTION

It is an object of the present invention to provide an air conditioner that has a dual air flow exit without requiring the use of a manifold style plenum chamber or other similar space consuming structure in the interior of the air conditioner.

It is a further object to provide a room air conditioner that uses a single blower wheel to recirculate room air and yet provide a dual return path in a compact format.

It is a further object of the invention to provide a housing for the single blower wheel which is formed of a foamed insulation material.

It is a further object of the invention to provide a room air conditioner in which the foamed insulation material forms two separate openings surrounding the blower wheel to divide the air flow exiting the blower wheel into separate air streams.

It is a further object of the invention to provide a room air conditioner having a foamed insulation housing for the air moving device which is formed in three separate pieces to expedite manufacturing and assembly of the housing, with the three pieces being contoured so as to precisely fit together for ease of assembly.

These and other objects are accomplished by providing a room air conditioner that has a centrally located evaporator coil and directly behind the evaporator coil is a blower wheel which is configured and arranged to draw air in through the center of the wheel and to cause the air to exit radially and tangentially as the wheel rotates. The wheel is located in a housing formed from three separate pieces of a foamed insulation material which are joined by matching contours of the pieces. The housing forms a pair of volutes with two separate openings that are configured and arranged so that approximately 50% of the air is caused to exit from each of the openings. The volute openings each communicate with a separate transition duct space, partially formed by the foamed insulation pieces, which lead directly to the front panel of the air conditioner. Separate opening controls are provided at each front panel opening so that the user can select the desired flow path for the exiting air.

The three insulation pieces, when assembled together, also assist in providing structural stability to the overall air conditioner assembly. A bottom one of the pieces also forms a collection pan for receiving condensed water from the evaporator and forms a pair of channels to direct the collected water through the barrier wall separating the evaporator compartment from the compressor/condenser compartment from where the condensed water will be thrown onto the condenser coil and/or evaporated and directed to the outside atmosphere. Other portions of the three pieces are apertured and configured to provide various passages for diverse components of the air conditioner thereby assisting in the assembly process while maintaining a minimum number of individual parts.

BRIEF DESCRIPTION OF THE DRAWINGS

FIG. 1 is a perspective view of a room air conditioner embodying the principles of the present invention.

FIG. 3 is a front view of the foamed insulation wall assembly in place in the air conditioner and showing the evaporator blower in phantom.

DETAILED DESCRIPTION OF THE PREFERRED EMBODIMENT

Figure 2:
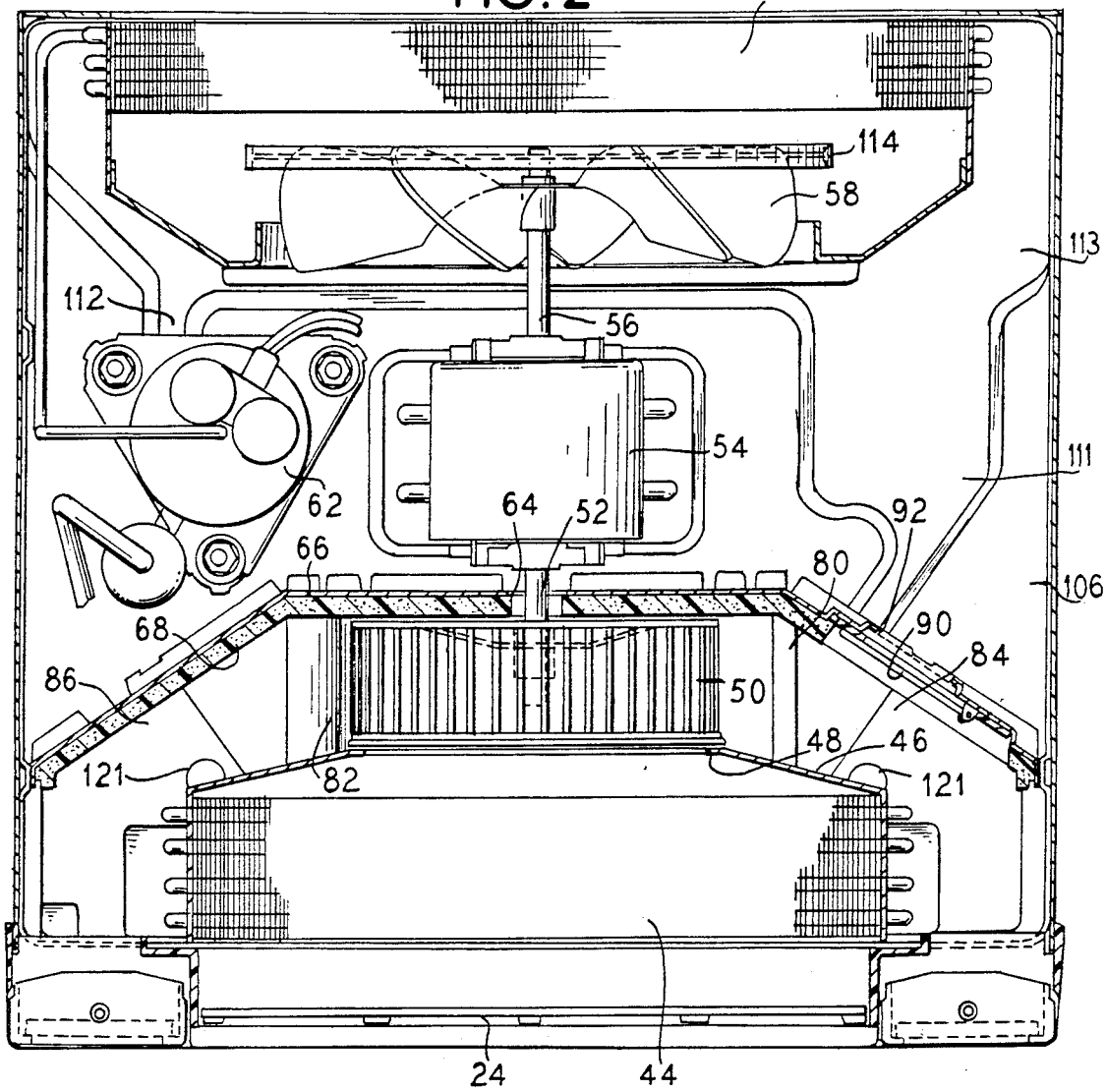
FIG. 2 is a top sectional view of the air conditioner of FIG. 1.
Figure 4:
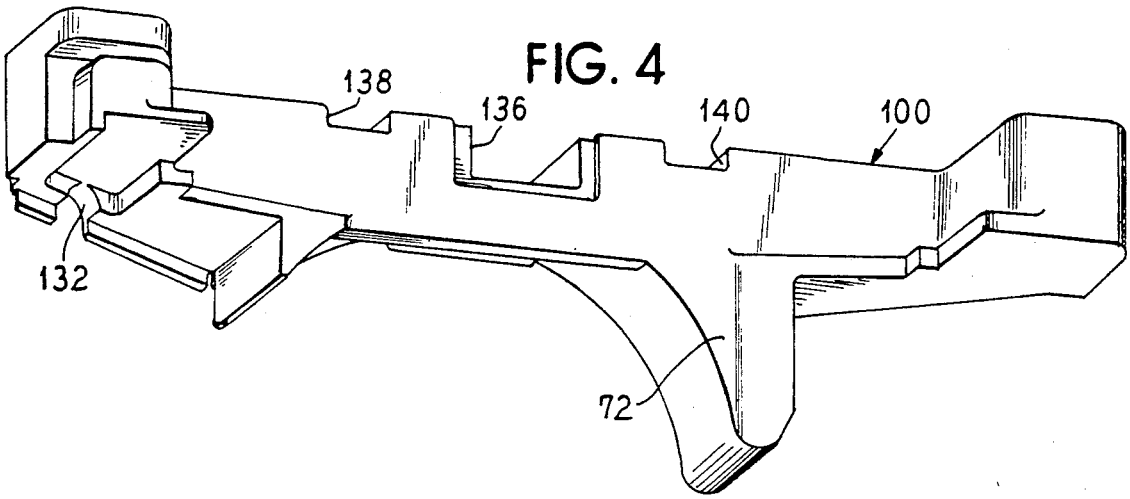
FIG. 4 is a front/lower perspective view of a top section of the foamed insulation wall assembly.
Figure 5:
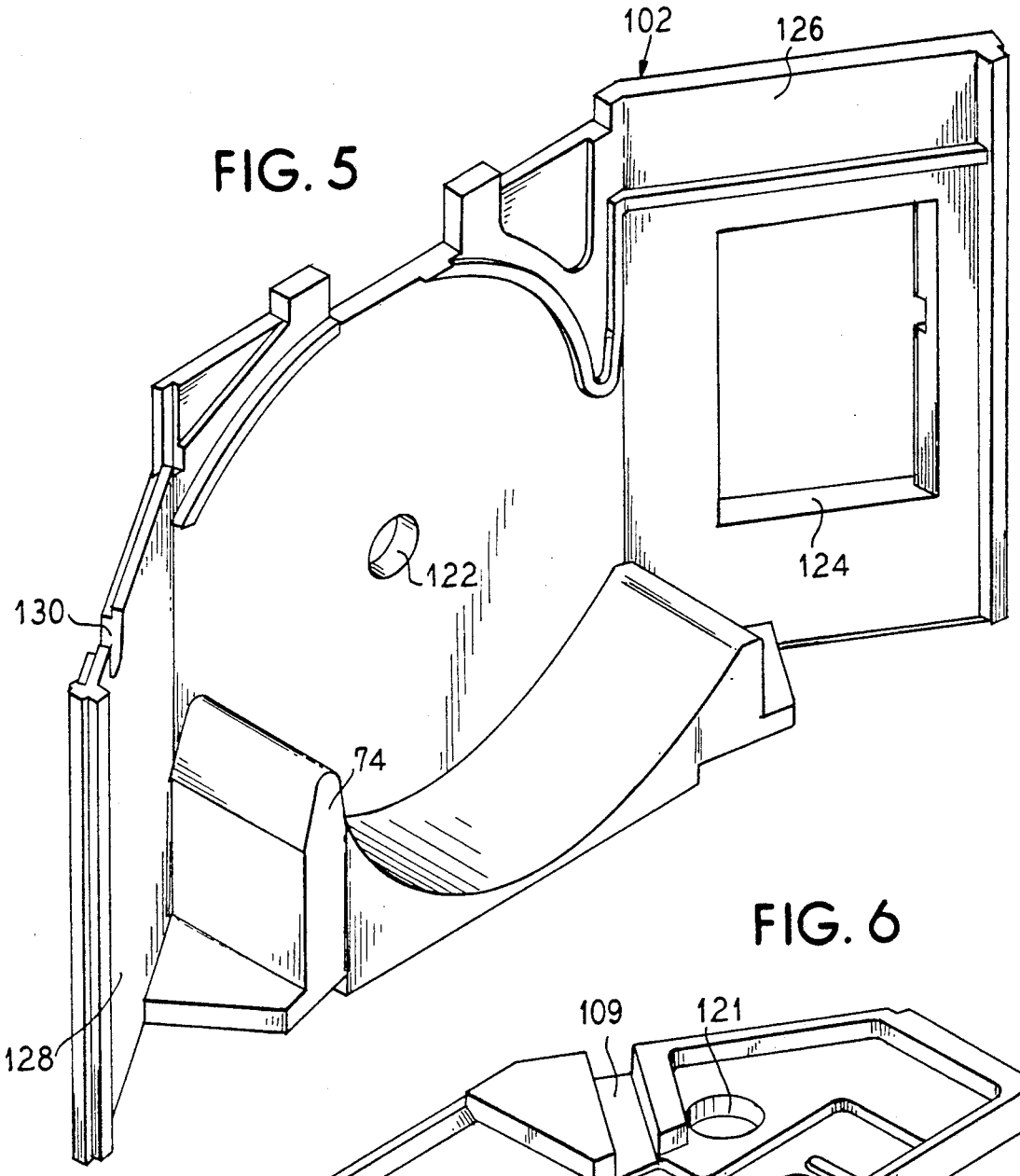
FIG. 5 is a front/upper perspective view of a middle section of the foamed insulation wall assembly.
Figure 6:
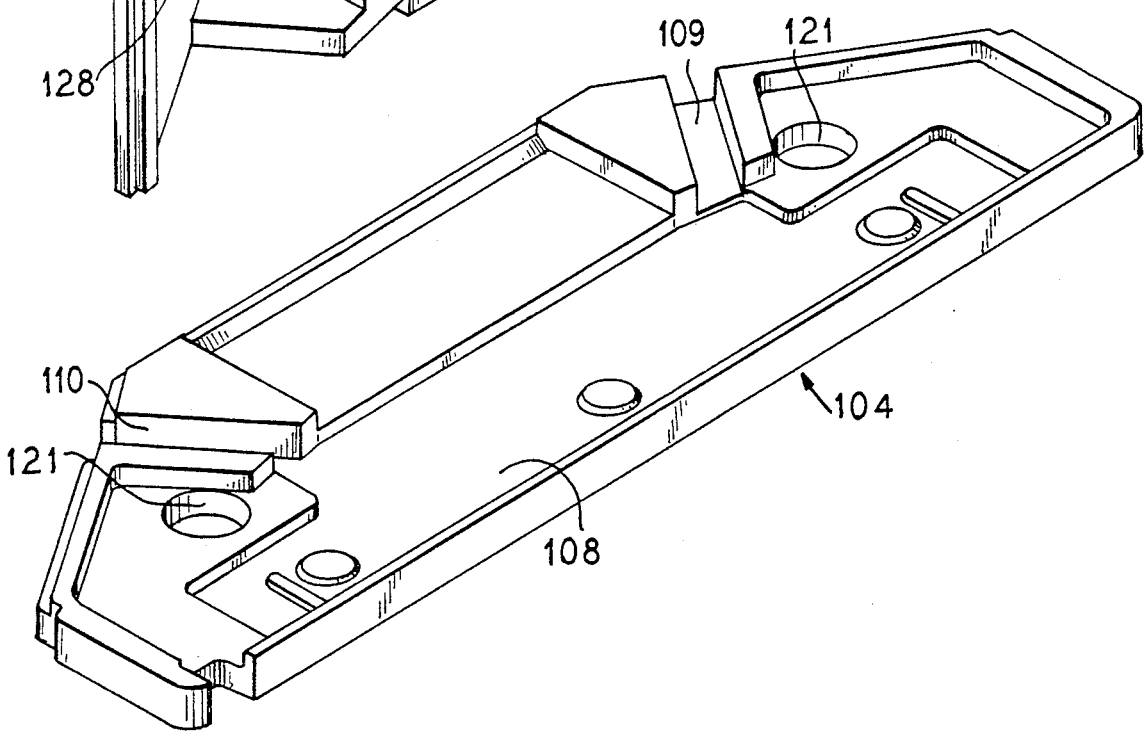
FIG. 6 is a front/upper perspective view of a bottom section of the foamed insulation wall assembly.

FIG. 1 illustrates an air conditioner generally at 20 which embodies the principles of the present invention. The air conditioner has a front panel 22 which faces the interior of a room to be cooled when the air conditioner unit is placed in an open window or in a through-the-wall sleeve. A central portion 24 of the panel constitutes an air inlet grill through which air flows into a portion of the air conditioning unit. The air is returned to the room through a pair of laterally spaced outlet grills 26. A particular preferred outlet grill construction is described in greater detail in copending application Ser. No. 522,198 entitled "Adjustable Louvers Assembly for a Room Air Conditioner" which disclosure is incorporated herein by reference. The outlet grills 26 are independently controllable by the user and contain louvers that are pivotable about both a vertical and horizontal axis giving the user a wide range of air flow configurations. The control of the air flow leaving the air conditioner is described in greater detail in copending application Ser. No. 522,199 entitled "Dual Louvered Side Air Discharge Openings For Room Air Conditioner" which disclosure is incorporated herein by reference.

A plurality of controls 28 are provided on a control paneled area. Positioned above the inlet grill 24 is a slot 30 within which is received an air filter element 32. The placement of the filter 32 causes the filter element to be readily accessible from the exterior of the air conditioner cabinet and does not require removal of any portions of the air conditioner cabinet in order for the filter to be removed to determine whether it needs to be cleaned. Replacement of the filter element is just as easy, that is by sliding the filter frame 34 into the slot 30.

The internal components of the air conditioner are shown in greater detail in FIG. 2. Directly behind the front inlet grill 24 is located the evaporator 44 which is mounted within a sheet metal housing 46. The housing 46 has a central rear opening 48 which is positioned directly in front of a blower wheel 50. The blower wheel 50 is mounted on a forwardly extending drive shaft 52 of an electric motor 54. The motor 54 also has a rearwardly extending drive shaft 56 to which a fan blade 58 is mounted. Directly behind the fan blade is the condenser coil 60. A compressor 62 is provided as is known in the art.

The forwardly extending drive shaft 52 extends through an opening 64 in a barrier wall 66 provided between the blower wheel 50 and the motor 52. The barrier wall 66 separates the cold side of the air conditioner (evaporator compartment forward of the wall) from the hot side (condenser, compressor compartment, rearward of the wall) while the air conditioner is operating to prevent air which has been chilled by passing through the evaporator 44 from being inadvertently discharged through the rear of the air conditioner and to prevent hot air in the condenser/compressor compartment of the air conditioner from being inadvertently drawn into the cold side of the air conditioner.

A barrier of foamed insulation such as expanded polystyrene 68 is provided along the barrier wall 66 which provides an insulation against heat transfer.

As best shown in conjunction with FIG. 3, as the blower wheel 50 rotates, air is drawn into the open center area 70 of the blower wheel 50 from through the opening 48 in the evaporator housing and is caused to leave the blower wheel radially and tangentially. The expanded polystyrene wall 68 includes forward projecting portions 72, 74 which surround the blower wheel and form a pair of volute passages 76, 78 which lead respectively to right and left lateral openings 80, 82. The volute passages 76, 78 and openings 80, 82 are configured and arranged so as to cause approximately 50% of the air flow generated by the fan blower 50 to exit through each opening. Adjacent and downstream of each opening 80, 82 is a transition air duct 84, 86 which is formed by a portion of the barrier wall 66 and is angled forwardly so as to redirect the air from the blower toward the front of the air conditioner.

As shown in FIGS. 2 and 3, an exhaust door 90 may be provided to cover an opening 92 in the portion of the barrier wall 66 which forms the transition duct 84. The position of the exhaust door may be controlled by one of the control knobs 28 on the front of the air conditioner.

Figure 7:
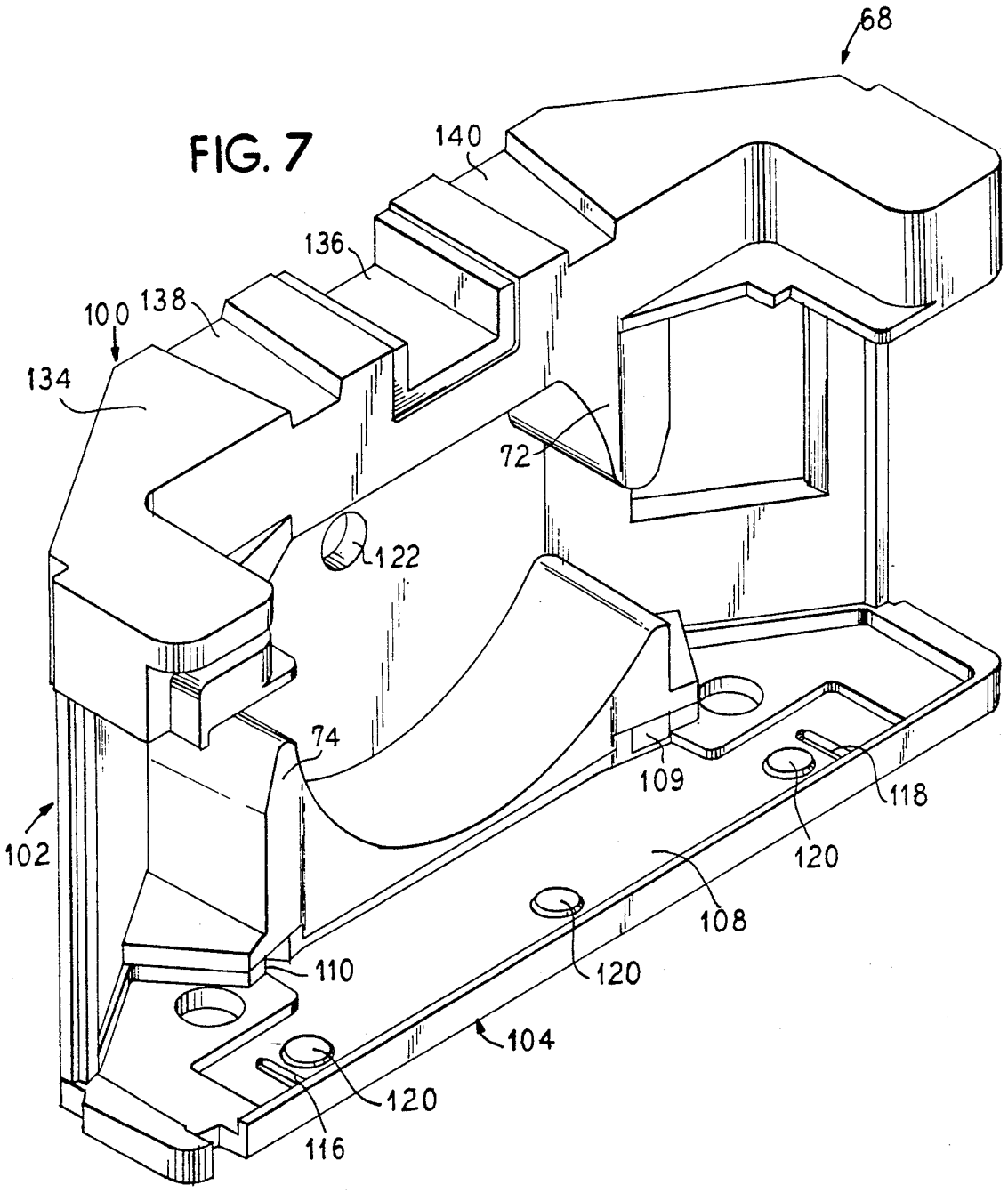
FIG. 7 is a front/upper perspective view of the assembled foamed insulation wall.

The expanded polystyrene wall 68 is shown in greater detail in FIGS. 3–7 where it is seen that the wall is comprised of three individual pieces, a top piece 100, a middle piece 102 and a bottom piece 104. The three pieces are provided with appropriate contours along their mating edges so as to fit together as shown in FIGS. 3 and 7 in a relatively air tight manner to form a housing for the blower wheel 50 as well as to form a portion of the transition air ducts 84, 86. The wall 68 is formed in three pieces to assist in the manufacturing process as explained in greater detail in co-pending application Ser. No. 522,180 entitled "ASSEMBLY METHOD AND APPARATUS FOR A ROOM AIR CONDITIONER", which is incorporated herein by reference. Briefly, in assembly, the bottom piece 104 is first assembled onto a base pan 106 (FIG. 2) and subsequently the middle section 102 is assembled to the bottom section 104. After assembly of various components the top section 100 is secured to the middle section 102.

In addition to the wall 68 forming a housing for the air moving device or blower wheel 50, the wall 68, and each of its components form other passages and components of the air conditioner apparatus. For example, the bottom section 104 includes a large central depressed or recessed area 108 which is positioned below the evaporator coil 44 and which collects condensed water from the evaporator coil. The collected water is channelled through two separate passages 109, 110 also formed in the bottom panel 104 which pass through the barrier wall 66 and lead to depressed areas or channels 111, 112 in the base pan 106 which lead to a reservoir area 113 from where the condensate is picked up by a slinger ring 114 on the condenser fan 58 to be removed from the air conditioner as described in greater detail in the co-pending patent application described above.

The recessed area 108 in the bottom piece 104 includes two locating ribs 116, 118 between which the evaporator 44 is placed. These locating ribs assist in the assembly of the device. Further, three raised bosses 120 are provided to space the bottom of the evaporator 44 slightly above the bottom of the depressed area 108 so that the evaporator will not be sitting in the collected water and to prevent further depressing the depressed area 108 thereby preventing the collected water from exiting through the channels 110, 112.

The bottom piece also includes two apertures 121 for receiving fastening tabs and fasteners associated with the evaporator.

The middle portion 102 includes a central aperture 122 for receiving the shaft 52 of motor 54. Further, the middle section 102 includes a large opening 124 in a wing portion 126 to receive the exhaust door 90. An opposite wing 128 has a notch 130 formed on a top thereof which mates with a notch 132 formed in the top portion to permit passage of coolant tubing extending between the compressor and the evaporator.

The middle portion 102 also includes the projecting portion 74 which forms the lower volute passage 78. The upper volute passage is formed by a projection 72 formed on the top portion 100. Openings 80 and 82 are formed between the end planes of the projecting portions 72, 74 of the top and middle portions.

The top portion 100 is configured on a top surface 134 thereof with a large central notch 136 which permits passage of a number of electrical wires running between the motor 54 and compressor 62 and a control box in which the control knobs 28 are mounted. The wires are formed in wiring harnesses which are shown and described in greater detail in co-pending application Ser. No. 522,172 entitled "DUAL SIDE DISCHARGE AIR HOUSING FOR A ROOM AIR CONDITIONER" which is incorporated herein by reference.

Also formed in the top surface 134 are two lateral channels 138, 140 which permit passage of securing straps (not shown) which are also shown and described in greater detail in the just mentioned patent application.

Thus, it is seen that the present invention provides a room air conditioner with an air moving device for causing air to flow in a stream through an evaporator coil and a housing surrounding the air moving device having a pair of openings for dividing the air stream into two separate air streams, the housing being comprised at least in part of foamed insulation walls forming the openings.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiment of the invention in which an exclusive property or privilege is claimed are defined as follows:

1. A room air conditioner comprising:

an evaporator coil centered on a center line of and at a front side of said air conditioner:

a condenser coil located at a rear side of said air conditioner;

a barrier wall separating said evaporator coil from said condenser coil;

an air moving device located in front of said barrier wall and centered behind said evaporator coil;

a housing surrounding said air moving device defined by foamed insulation walls centrally located directly behind said evaporator coil and in front of said barrier wall, said air moving device being arranged in said housing so as to draw air in a stream from in front of said air conditioner through said evaporator coil and into said air moving device;

a pair of openings in said housing defined by said foamed insulation, being substantially equal in size and shape and positioned on opposite sides of said air moving device, said housing, air moving device and openings defining means for dividing the air stream into two separate and substantially equal air streams after it has passed through said air moving device and to direct said separate air streams toward two separate air exit openings at said front side of said air.

2. A room air conditioner according to claim 1, wherein said housing has a rear wall which abuts against said barrier wall.

3. A room air conditioner according to claim 1, wherein said air moving device comprises a blower wheel mounted on a horizontal axis.

4. A room air conditioner according to claim 3, wherein said housing comprises a pair of volute passages enclosing said blower wheel.

5. A room air conditioner according to claim 1, wherein each one of said pair of openings in said housing communicates with a different one of said two separate air exit openings by means of a connecting air conduit.

6. A room air conditioner according to claim 5, wherein said separate air streams are directed by said air moving device in an exit direction other than forward and said connecting air conduits have angled walls formed integrally with at least a portion of said foamed insulation of said housing to redirect said split air flow from an exit direction to a forward direction.

7. A room air conditioner according to claim 3, wherein said housing is formed in three separate pieces of foamed insulation.

8. A room air conditioner according to claim 7, wherein said three separate pieces have mating surfaces such that each piece mates with at least one other piece.

9. A room air conditioner according to claim 7, wherein a bottom one of said pieces forms a floor upon which sets said evaporator.

10. A room air conditioner according to claim 9, wherein said bottom one of said pieces has a depressed area below said evaporator for receiving condensed water vapor from said evaporator.

11. A room air conditioner according to claim 10, wherein said bottom one of said pieces forms at least one passage from said depressed area to an opening in a wall separating said evaporator from a condenser.

12. A room air conditioner according to claim 7, wherein a central one of said pieces forms a vertical rear wall of said housing.

13. A room air conditioner according to claim 12, wherein said central one of said pieces includes right and left lateral wings, said wings forming a wall portion of separate air conduits leading from said blower wheel to separate air outlet openings at a front side of said air conditioner.

14. A room air conditioner according to claim 8, wherein a top one of said pieces forms a top wall of said housing.

15. A room air conditioner comprising:

an evaporator coil centered on a center line of and at a front side of said air conditioner;

a condenser coil located at a rear side of said air conditioner;

a barrier wall separating said evaporator coil from said condenser coil;

a rotatable blower wheel located in a housing comprising a pair of volute passages defined by a foamed insulation material enclosing said blower wheel, said blower wheel being centrally located directly behind said evaporator coil and in front of said barrier wall, said blower wheel being arranged so as to draw air in a stream from in front of said air conditioner through said evaporator coil and into said blower wheel;

a pair of openings in said housing defined by said foamed insulation material arranged at opposite lateral sides of said blower wheel for dividing the air stream into two separates and substantially equal air streams after it has passed through said air moving device and to direct said separate air streams through two separate air conduits being substantially equal in size and shape and being positioned symmetrically relative to said center line, toward two separate air exit openings of substantially equal size and shape at said front side of said air conditioner, said separate air streams being directed by said air moving device in an exit direction other than forward and said connecting air conduits having angled walls formed integrally with said foamed insulation material of said housing to redirect said split air flow from an exit direction to a forward direction, said openings, air conduits and air exit openings defining means for evenly drawing air into said air conditioner, split into two relatively equal streams and directed out of said air conditioner in two streams of substantially equal air flow.

* * * * *